United States Patent [19]

Beeder

[11] 4,283,059

[45] Aug. 11, 1981

[54] BOARD GAME APPARATUS

[76] Inventor: Wayne A. Beeder, Overhill Rd., Stormville, N.Y. 12582

[21] Appl. No.: 812,523

[22] Filed: Jul. 5, 1977

[51] Int. Cl.[2] ..... A63F 3/00

[52] U.S. Cl. ..... 273/254; 273/288; 273/256; 273/284

[58] Field of Search ..... 273/284, 241, 256, 251, 273/255, 253, 288

[56] References Cited

U.S. PATENT DOCUMENTS

| | | | |
|---|---|---|---|
| 795,822 | 8/1905 | Darius | 273/288 |
| 1,544,254 | 6/1925 | May et al. | 273/251 |
| 2,088,137 | 7/1937 | McAbee | 273/256 |
| 2,273,292 | 2/1942 | Smith | 273/255 |
| 2,729,451 | 1/1956 | Larson | 273/241 |
| 3,756,604 | 9/1973 | Laszlo | 273/256 |
| 3,973,775 | 8/1976 | Bolan | 273/253 |
| 4,043,559 | 8/1977 | Eigen | 273/284 |

OTHER PUBLICATIONS

*Twixt;* Spring/Summer '78 Catalog of Games, Avalon Hill Game Co.

*Primary Examiner*—Richard C. Pinkham
*Assistant Examiner*—R. Carl Moy
*Attorney, Agent, or Firm*—Richards, Harris & Medlock

[57] ABSTRACT

A board type game to be played competitively between several players; the game representing competing airlines flying between various cities, so as to acquire a monetary gain; the game includes a gameboard with a playing course imprinted thereupon for playing pieces to travel thereupon, a map showing travel routes imprinted on the gameboard, and the game also includes play money for transactions between the players, a pair of dice and a spinner, a deck of cards, and specialized other pieces particular to the game including control towers, connector bars, merger bars and grand merger bars.

18 Claims, 13 Drawing Figures

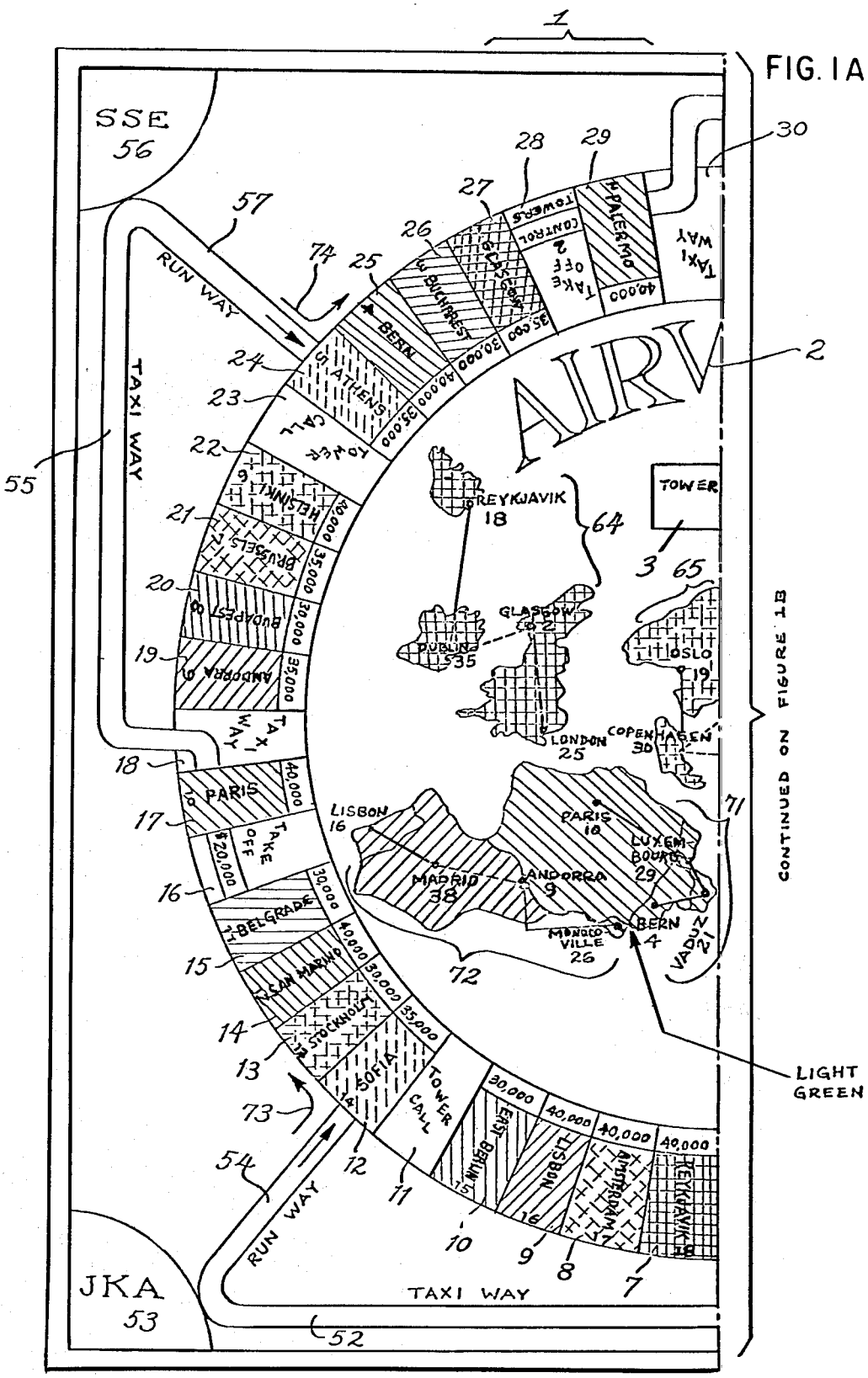
FIG. 1A
SSE
56
JKA
53
RUN WAY
TAXI WAY
TAXI WAY
TAXI WAY
AIRV
TOWER
TAKE OFF
CONTROL TOWERS
BUCHAREST
BERN
ATHENS
CALL TOWER
HELSINKI
BRUSSELS
BUDAPEST
ANDORRA
PARIS
BELGRADE
MADRID
STOCKHOLM
SOFIA
BERLIN
LISBON
ROME
REYKJAVIK
REYKJAVIK
PALERMO
REYKJAVIK
GLASGOW
DUBLIN
OSLO
LONDON
COPENHAGEN
PARIS
LISBON
MADRID
LANDORRA
LUXEMBOURG
MONACO VILLE
BERN
VADUZ
LIGHT GREEN
CONTINUED ON FIGURE 1B

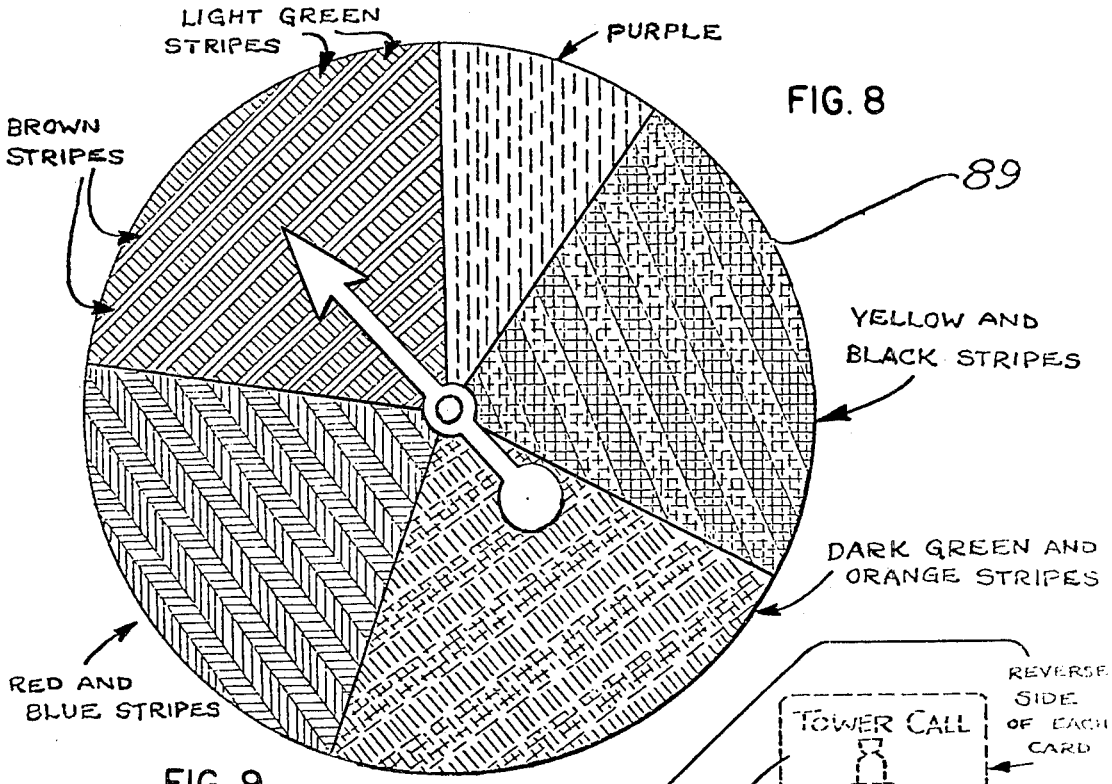
FIG. 8
FIG. 9
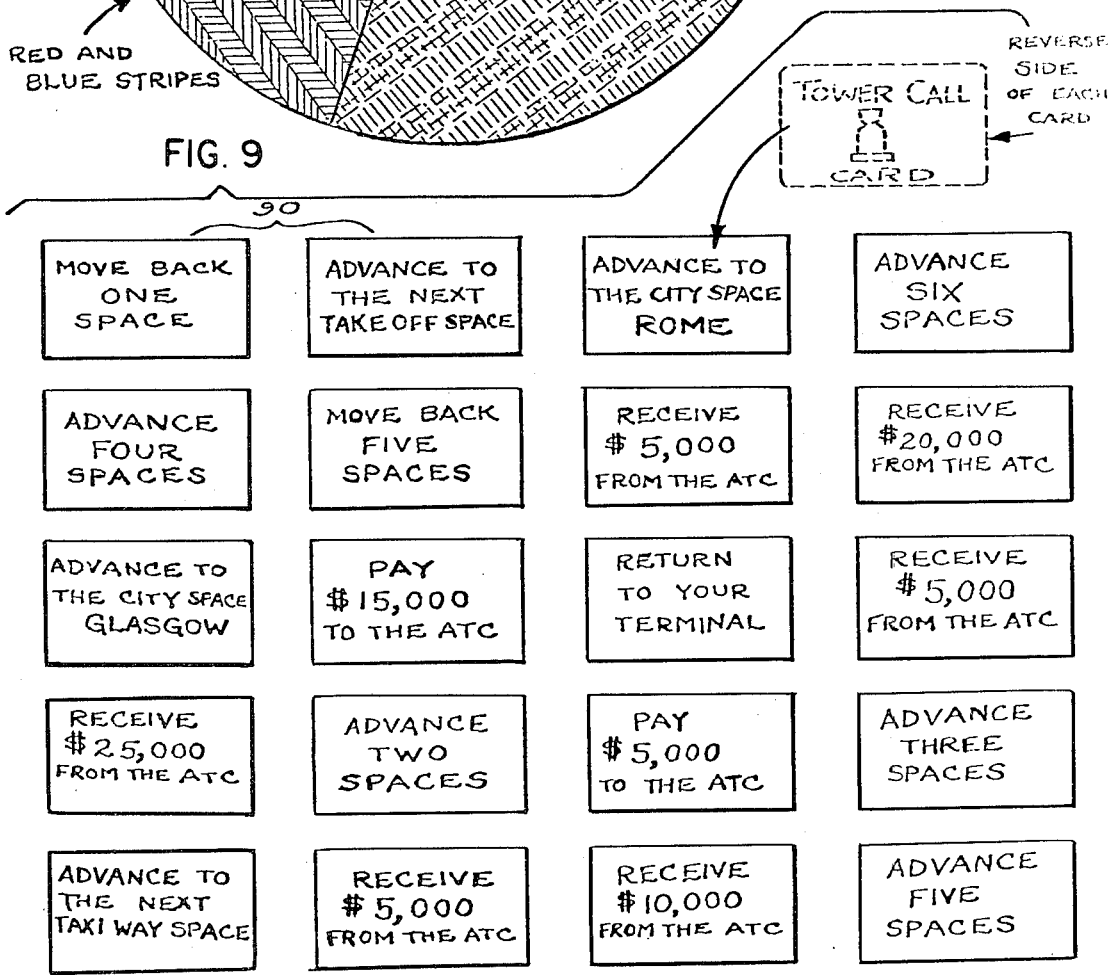

FIG. 10
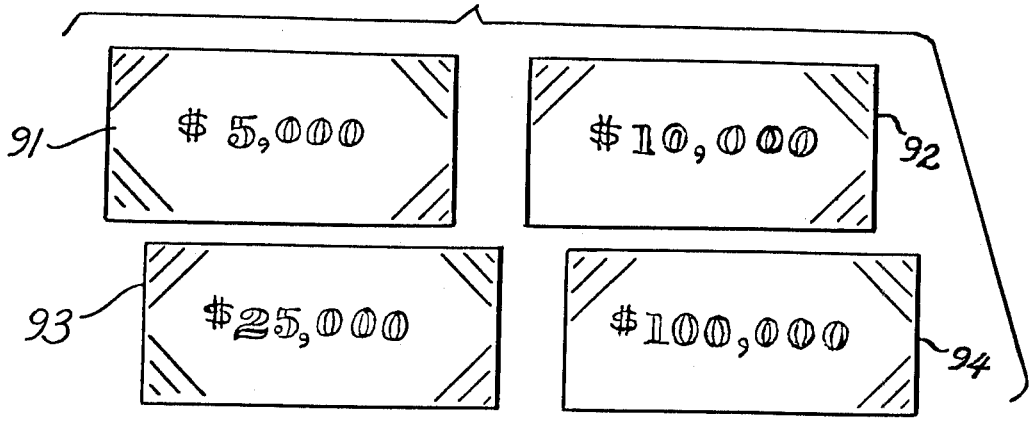
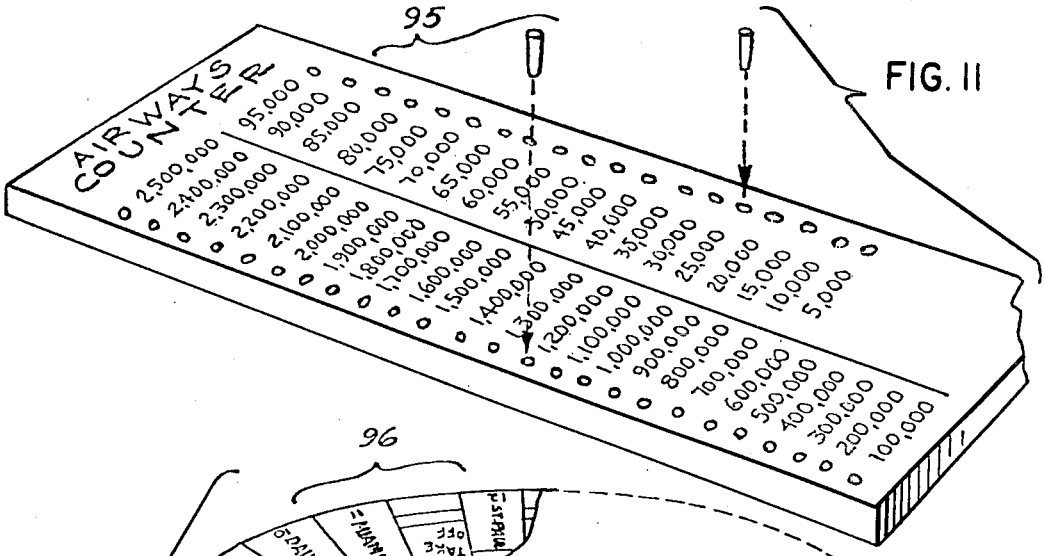
FIG. 11
FIG. 12
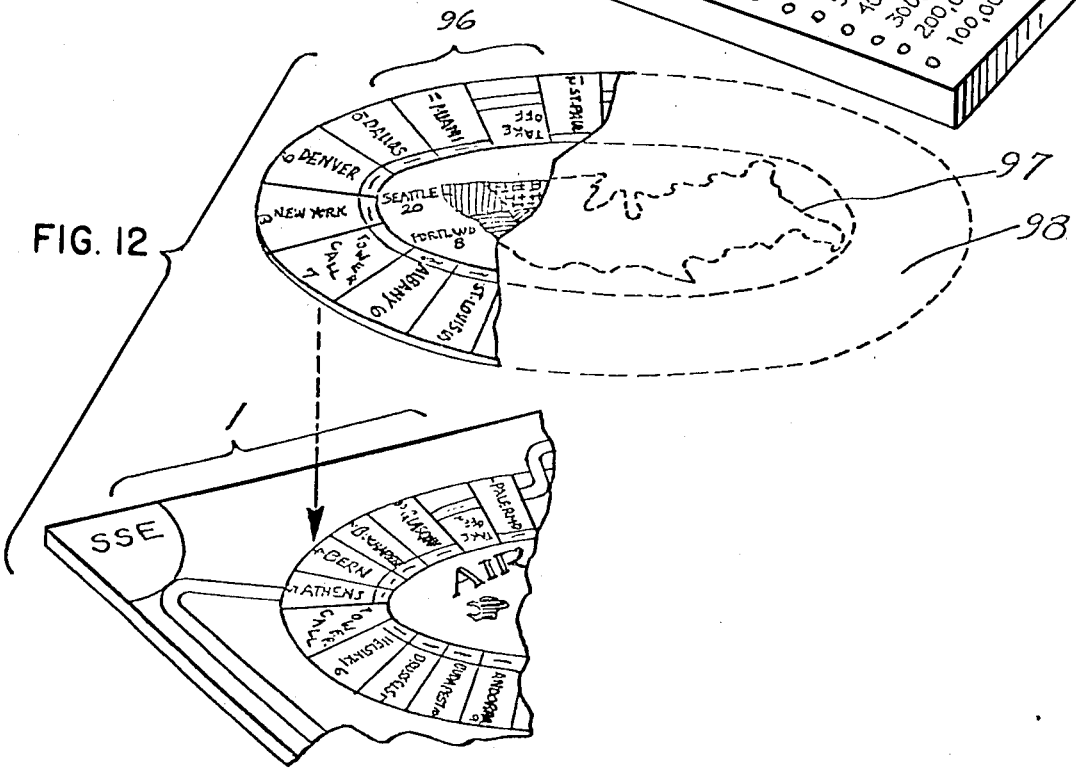

BOARD GAME APPARATUS

This invention relates generally to board games, such as may be played upon a table with competing players seated around the table. More particularly, it relates to board games of the type that include a course of spaces imprinted thereupon, and along which playing pieces are moved by the players.

A principal object of the present invention is to provide a board game apparatus, in which each player tries to build the largest airline system or industrial airline empire through inter-connecting world-wide routes.

Another object is to provide a board game apparatus, which, while incorporating the feature of being a game of chance by the use of throwing dice, does, additionally, include the judgment of a player in order to achieve a goal, so that any mis-judgment and resultant mis-calculations may force a player to revise his strategy as he attempts to consolidate his system.

Another object is to provide a board game apparatus, which, accordingly, has, additionally, the features of a game of skill, so that it develops a player's thinking and intelligence.

Still another object is to provide a board game apparatus, which can be played by players young and old, so that it is an ideal family game.

Other objects are to provide a board game apparatus, which is simple in design, inexpensive to manufacture, rugged in construction, and which provides diversion and entertainment that is completely absorbing by stirring a player's imagination that he is actually an operator of a real airline.

These and other objects will become readily evident upon a study of the following specification and claims taken in conjunction with the accompanying drawings and wherein the principles of the present invention will be apparent by the single embodiment thereof presented in the following figures:

FIGS. 1A and 1B in a combination form a FIG. 1, which is a plan view of one form or arrangement of the board or playing surface for the game, the lettering on the respective spaces or areas being clearly represented, and the distinctive colors being indicated thereon, according to the chart for draftsmen in the Patent Office Rules of Practice;

FIG. 8 is a view of the spinner used, in part, to determine penalties during the game (it is to be noted that the spinner is not a substitute fo the dice in FIG. 7); the color sections on the spinner determine only from which color section, on the central pictorial map, that a player removes an opponent's Control Tower, when under a penalty situation;

FIG. 9 represents Twenty Tower Call Cards which are to be drawn from, individually, by every player who moves onto a Tower Call space or area of the board;

FIG. 10 is a view of the play or scrip money, used in denominations of $5,000.00, $10,000.00, $25,000.00 and $100,000.00;

FIG. 11 is a view of the Airways Counter, one for each of the several players, to maintain a running total of the player's score during the course of the game;

FIG. 12 is a fragmentary perspective view showing a modified form of the game board, in which another course or pattern containing different City Spaces, and their corresponding central pictorial map locations, may be placed over the original course.

Figure 1B:
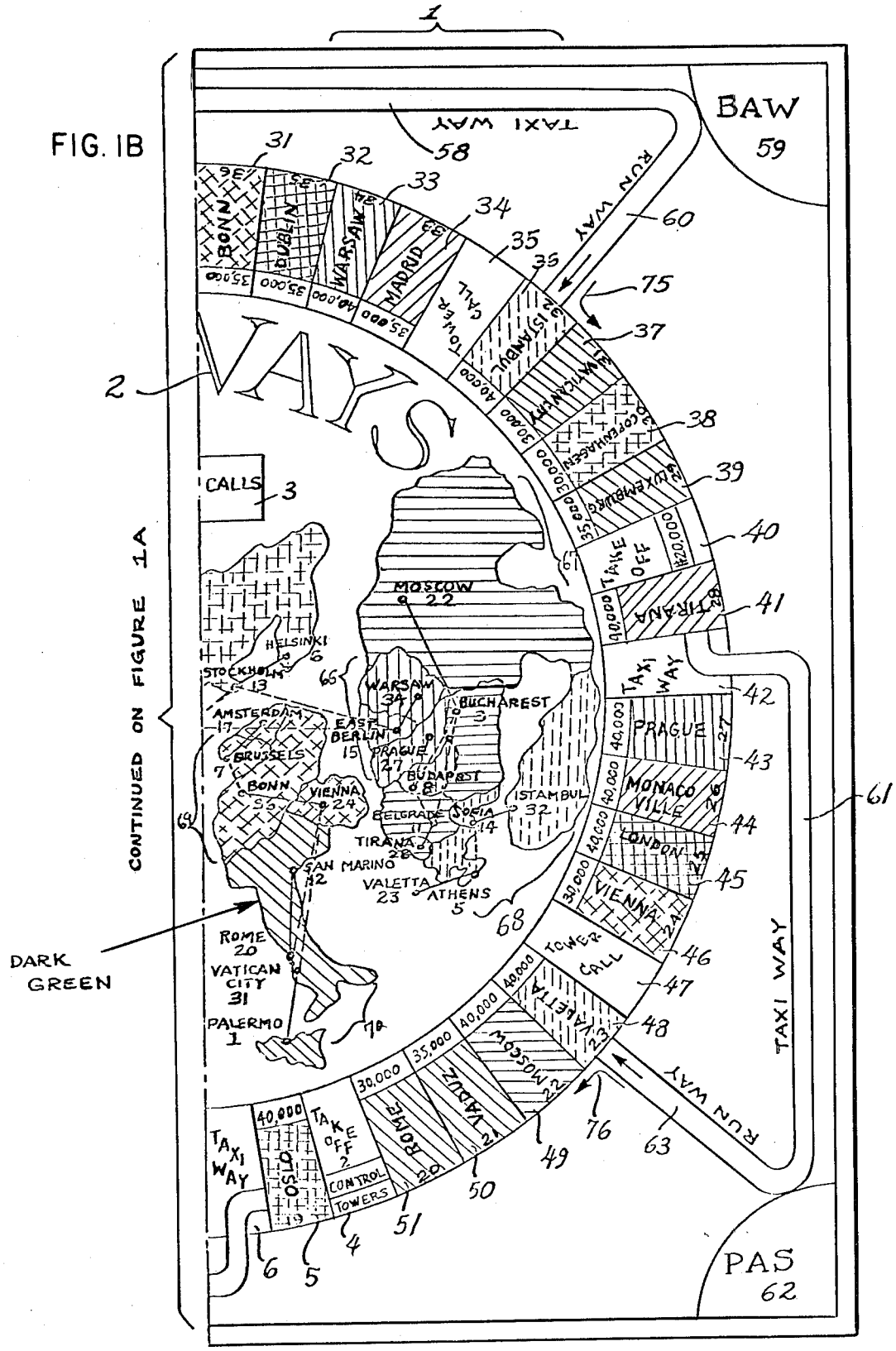

While I have illustrated, and will now describe in detail, the specific form of my invention involving City Spaces or locations outside the continental United States, it is to be understood that, in its broader aspect, my invention is not limited to the representation (among other features) of these City Spaces or locations, inasmuch as other City Spaces or locations are comprehended within the scope thereof, as embodied in the plan view showing a modified form of the game board. As will be hereinafter set forth, there are, in the presented form of the invention, thirty-six City Spaces or locations designated upon the board, and according to the throw of the dice, the players may move onto some one or another of the City Spaces, on which they then may acquire the landing rights, or may acquire the landing rights through payment to the Air Traffic Controller, who is preferably one of the players. The players then attempt to increase their airline landing right holdings. Each of the players, at the beginning of the game, is furnished with a certain amount of game or scrip money, say $600,000.00, $720,000.00, $840,000.00, respectively, for four, three or two players, respectively, and each player, as his symbol or token airplane is moved according to the throw of the dice, about the arrival and departure course or pattern, repeatedly, so long as the game continues, will, in accordance with the throw of the dice, land at times upon one of the Tower Call areas, instead of upon a City Space, whereupon he must draw a card from the pile of Tower Call cards, which cards indicate some financial reward, penalty or other benefit whereby his capital is augmented or diminished.

Or, he may land upon one of the four Takeoff spaces, or one of the four Taxiway spaces; the action to be taken in each will be fully set forth in the ensuing, specific description of the selected form of the invention, to which, however, my invention is not limited excepting as hereinafter set forth in the claims.

The board, as a whole, is indicated at 1 in combined FIG. 1. Inasmuch as the game is known upon the market as AIRWAYS, that name is indicated at 2 on the board, whereon at 3 is indicated the place where the set of Tower Call cards is piled, preferably face down. Any player who is compelled, by the rules of the game, to draw a Tower Call card, takes the top card from the pack, and, after following the instructions printed thereon, returns the card face down to the bottom of the pack.

The arrival and departure course or pattern made up of the forty-eight spaces or areas, extends entirely about the circular portion on the board, thus forming a course or circuit, about which the symbols or tokens of the players are moved, according to the throw of the dice, as long as the game continues about this course or circuit or a temporary return to the terminal areas. In other words, the course or playing field possesses no goal or termination, or winning point, but affords a circuit for continuity of play. The play begins from one of the terminals on FIG. 1 at 53, 56, 59 or 62, as later set forth in the specific description. Entry to the arrival and departure course or pattern, from the terminals, is made by moving the token out the runways, noted at 54, 57, 60 or 63 to enter at the respective City Space noted at 12, 24, 36, 48. The spaces on the arrival and departure course or pattern are consecutively numbered from 4 to 51 inclusive. A player leaving the arrival and departure course or pattern exits from the Taxiway space, noted at 6, 18, 30, or 42, and travels along the taxiway path, noted at 52, 55, 58 or 61 to the terminal. The City Spaces, identified on the arrival and departure course or pattern, are further identified in the corresponding central pictorial map, noted at 64 to 72.

Thirty-six of these spaces are City Spaces or locations, and each of them bears a name of a prominent world city, all clearly marked upon combined FIG. 1. Moreover, the said City Spaces are sufficiently marked in color. The City Spaces are herein shown arranged in groups, each group being indicated by a distinctive color. Thus, a single group will include a certain number of City Spaces, which, in the example of the invention, are of four spaces in each group, and in a form that is readily recognized as such in the playing of the game.

Thus, it will be noted that the City Spaces on the arrival and departure course or pattern, and the corresponding central pictorial map, are arranged in various color groups in combined FIG. 1. The City Spaces 14, 29, 37, 51 constitute a single group, and are colored dark green at the inner end thereof. The City Spaces 7, 27, 32, 45 constitute a single group, and are colored black at the inner end thereof.

The City Spaces 15, 26, 41, 49 constitute a single group, and are colored blue at the inner end thereof. The City Spaces 17, 25, 39, 50 constitute a single group, are are colored light green at the inner end thereof. The City Spaces 12, 24, 36, 48 constitute a group, and are colored purple at the inner end thereof. The City Spaces 5, 13, 22, 38 constitute a group, and are colored yellow at the inner end thereof. The City Spaces 18, 21, 31, 46 constitute a group, and are colored orange at the inner end thereof. The City Spaces 10, 20, 33, 43 constitute a group, and are colored red at the inner end thereof. The City Spaces 9, 19, 34, 44 constitute a group, and are colored brown at the inner end thereof.

The corresponding color sections in the central pictorial map contain the name of the world city, in its proper geographic map location, as noted in the City Spaces. The group colored black is noted at 64. The group colored yellow is noted at 65. The group colored red is noted at 66. The group colored blue is noted at 67. The group colored purple is noted at 68. The group colored dark green is noted at 69. The group colored orange is noted at 70. The group colored light green is noted at 71. The group colored brown is noted at 72.

The same thirty-six City Spaces have, imprinted in the color section at the inner end, the landing rights fee value for that particular space. A landing rights fee of $30,000.00 is noted in City Spaces 10, 13, 15, 20, 26, 37, 38, 46, 51. A landing rights fee of $35,000.00 is noted in the City Spaces 12, 19, 21, 24, 27, 31, 32, 34, 39, 50. A landing rights fee of $40,000.00 is noted in City Spaces 5, 7, 8, 9, 14, 17, 22, 25, 29, 33, 36, 41, 43, 44, 45, 48 and 49.

To assist in rapid identification from the City Space on the arrival and departure course or pattern to the world city on the central pictorial map, a reference number system is shown at the outer end of each City Space, and the same reference number noted beneath the name of the world city on the central pictorial map. An example of which is noted on the City Space—Palermo—whereby a reference number of 1 is noted at the outer end of the City Space and beneath the same world city named on the central pictorial map. The same reference number system continues counterclockwise for each City Space, to the right of the last, until reaching the thirty-sixth City Space or Bonn, as depicted in the embodiment of my invention on the arrival and departure course or pattern.

Interspersed among the said thirty-six City Spaces are certain other areas, which are in this example of the invention, Tower Call card spaces (the term "Tower Call" being merely the nomenclature to identify the cards) Taxiway spaces and Takeoff spaces. In the disclosed form of the invention, there is a Tower Call card space at 11, 23, 35, 47. There are four areas for Taxiway spaces at 6, 18, 30, 42. The Takeoff spaces are noted at 4, 16, 28, 40.

A game can be played by four players, three players or two players. At the beginning of the game, one of the players is chosen AIR TRAFFIC CONTROLLER (hereinafter referred to as the ATC). The ATC's functions are: preparing the game, and making proper distribution of the money, Control Towers, Connector Bars, Merger Bars and Grand Merger Bars. Such person may also act as one of the players, and, for that purpose, will be provided with an equal sum of money, and in all ways will participate in the game with the other players. At the beginning of the game, the ATC places the board on a table, putting the Tower Call cards face down on the alloted space on the board. He also sets the Spinner, FIG. 8 at 89, near the board.

Figure 2:
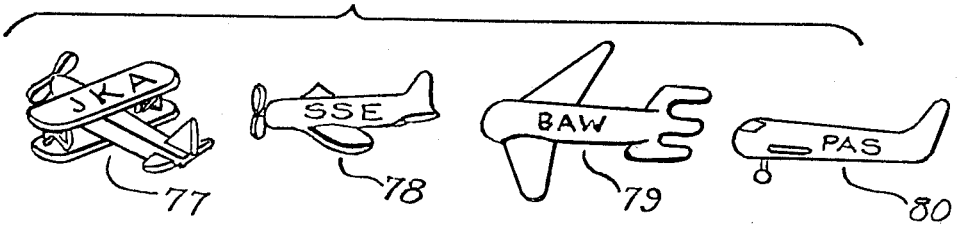
FIG. 2 is a view of symbols or tokens that are used by the several players, respectively, and which are shaped in representation of various airplanes.

A symbol or token is provided for the players, respectively, and which are herein represented in FIG. 2 at 77 to 80 inclusive, whereby 77 is further identified as a bi-plane, with the initials of JKA on the plane, to represent the symbolic Jalo Kai Air-lines; whereby 78 is further identified as a single engine plane with the initials of SSE on the plane to represent the symbolic South-Hampton Seas Express Airline; whereby 79 is further identified as a constellation with the initials of BAW on the plane to represent the symbolic Bonnaire Air World Airline; whereby 80 is further identified as a cargo plane with the initials of PAS on the plane to represent the symbolic Pan African Services Airline.

Figure 3:
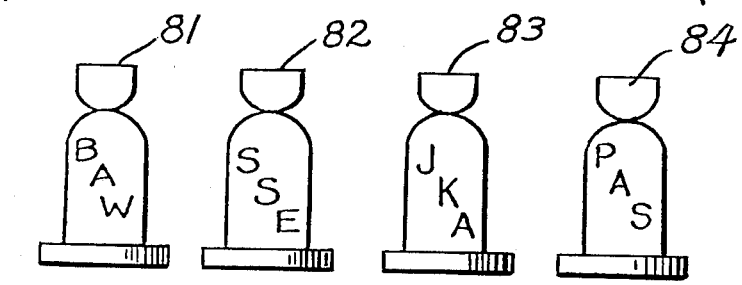
FIG. 3 is a view in elevation of the Control Towers used by the several players, with terminal identification shown on each, to represent the four terminals on the board.

Each player is given the following Control Towers by the ATC as herein represented in FIG. 3 at 81 to 84 inclusive, whereby 81 represents BAW Control Towers; whereby 82 represents SSE Control Towers; whereby 83 represents JKA Control Towers; whereby 84 represents PAS Control Towers in the following units dependent on the number of players. For four players, each player receives 20 Control Towers of his airline. For three players, each player receives 24 Control Towers of his airline. For two players, each player receives 32 Control Towers of his airline. Sufficient Control Towers of each airline remain for distribution by the ATC throughout the game.

It will be understood that the game money or scrip dollars, indicated in FIG. 10 at 91 to 94 inclusive, in denominations of $5,000.00, $10,000.00, $25,000.00 and $100,000.00, is in charge of the ATC who, at the beginning of the game, provides each of the players, including himself, if he so participates, with the following amount, dependent upon the number of players: for four players, each player receives $600,000.00 divided as follows—two $100,000.00, eight $25,000.00, sixteen $10,000.00, and eight $5,000.00; for three players, each player receives $720,000.00 divided as follows—two $100,000.00, ten $25,000.00, twenty-two $10,000.00, and ten $5,000.00; for two players, each player receives $840,000.00 divided as follows—three $100,000.00, twelve $25,000.00, sixteen $10,000.00 and sixteen $5,000.00. Sufficient money remains for distribution by the ATC throughout the game.

The game money and the player's Airline Control Towers comprise the Player's Hand.

Each player is given an Airways Counter, depicted in FIG. 11 at 95, by the ATC to keep a constant total of his airline system, or empire's value, to reflect a total at any time during a game. Dependent upon the money received, a player initially establishes the value of his empire by locating the two pegs in the appropriate holes. The left side of the Airways Counter is in units of $100,000.00 per hole. The right side of the Airways Counter is in units of $5,000.00 per hole. For example, with two players, one peg is placed in the hole next to the numerical 800,000, and the other peg is placed next to the numerical 40,000. As value is added or subtracted, the pegs are moved accordingly. While each player maintains his own score, any other player can quickly tell an opponent's score by viewing the counter of the player.

Figure 7:
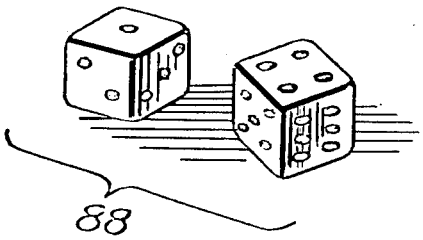
FIG. 7 represents, in perspective, the dice used to determine the extent of length of the moves of the players along the arrival and deparature course or pattern.

Each player, starting with the ATC, rolls the dice, depicted in FIG. 7 at 88. The one with the highest total starts the play. That player rolls the dice, moves his airplane token out from the terminal, for example the BAW terminal, in combined FIG. 1 at 59 by the runway in combined FIG. 1 at 60, to the arrival and departure course or pattern City Space, in combined FIG. 1 at 36. He then moves his airplane token in the direction of the arrow depicted in combined FIG. 1 at 75, and also arrows at 73, 74, 76 clockwise, the number of spaces indicated by the dice, beginning the count with the entry to the City Space, in combined FIG. 1 at 36, on the arrival and departure course or pattern. As an example, a player who initially throws dice totalling five, moves his airline token out the runway to the identified City Space on the arrival and departure course or pattern. The player begins his count on that space which counts as number one, and then proceeds four more spaces, so as to reach his dice throw of five. Action, upon reaching that space, depends on the particular space. Upon completion of his play, the turn passes to the left, with the other players following in sequence. The airplane tokens remain on the spaces or locations occupied, and proceed from that point on the player's next turn. Two or more airplane tokens may remain on the same space or location at the same time.

The action taken by a player, on the arrival and departure course or pattern, depends on the space reached by his airplane token. The player may be extended the opportunity to purchase landing rights, when on a City Space, or decline the same at his option, pay penalty fees, draw a Tower Call card, depicted in FIG. 9 at 90, or follows the rules when landing on a Takeoff space, for example, in combined FIG. 1 at 40, or a Taxiway space, for example, in combined FIG. 1 at 42. The following action is taken by a player when he lands: on a Takeoff space, the player landing on a Takeoff space receives either two of his control towers in combined FIG. 1 at 4, 28 or $20,000.00 from the ATC, in combined FIG. 1 at 16, 40, whichever is designated on the space; on a Tower Call space, the player draws a card from the top of the pack, follows the instructions printed on the card and returns that card, face down, to the bottom of the pack; on a City Space, if a player has available money and lands, whether by the throw of the dice or by a move forced by the draw of a Tower Call card, on a City Space that does not contain a Control Tower in the inner end thereof of the City Space, the player must decide to pay the fee for landing rights, or pass. If the decision is to pay the fee, the player:

(a) gives the ATC the amount of money stated for the landing rights in the inner end of the City Space;

(b) places one of his Control Towers in the inner end of the City Space, over the landing rights dollar amount and;

(c) places a Control Tower on the corresponding space on the central pictorial map on the point indicated next to the identical name of the City Space. When a player lands on a City Space, and does not have either sufficient money or Control Towers, in his hand to pay the landing rights fee, but has Control Towers on the central pictorial map, the turn passes to the next player. While the player pays the ATC a landing rights fee, which lowers his total money value—his Control Towers, which up to this point did not have any value, now gain a value, when used in play equal to the landing rights fee. Therefore, a player's empire value does not change, as the money given the ATC, for example, $40,000.00, which would lower the total, is regained by placing one Control Tower on the inner end of the City Space, and one Control Tower on the corresponding space on the central pictorial map, on the point indicated next to the identical name of the City Space; on a Taxiway space, the player landing on the space must pay a penalty, prior to continuing play. The player moves his airplane token off the arrival and departure course or pattern Taxiway Space, for example, in combined FIG. 1 at 42, along the Taxiway, in combined FIG. 1 at 61, to the terminal, in combined FIG. 1 at 62. When the terminal is that of a player's token, he loses one turn, before being allowed to restart, by again throwing the dice, and moving out the runway, in combined FIG. 1 at 63, to the arrival and departure course or pattern. If the terminal is not his own, he loses a turn and pays $10,000.00 to the terminal owner. In the case of two or three players, the penalty is paid to the ATC when a player lands in a terminal not being used for that game.

If a player throws doubles on the dice, for example, two and two, he moves his airplane token as usual, and is subject to the action required for landing on any City Space. Any other space reached—Taxiway, Tower Call or Takeoff—automatically ends the doubling privilege. A player continues to throw doubles as long as they appear, and subject to the above.

Figure 4:
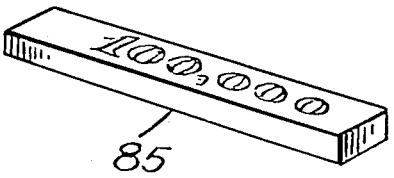
FIG. 4 is a perspective view of a Connector Bar, imprinted to show a value, in the play of the game, of $100,000.00.

When two named City Spaces are connected by a solid red line on the central pictorial map, and contain the same airline Control Towers, a Connector Bar, FIG. 4 at 85, is requested from the ATC to be placed between them, by setting the bar on the flat surfaces of the Control Towers. Examples are London and Glasgow, Athens and Valetta, and are hereinafter referred to as a Control Tower Pair, when a connector Bar is in place.

Placement of a Connector Bar is not permanent. A player meeting the requirements outlined further in the description, describing the various penalties, may force removal of a Control Tower from the central pictorial map, and its corresponding Control Tower from the City Space. Each two named City Spaces, joined by a Connector Bar, increases a player's airline system or empire value by $100,000.00, as noted on the bar. The player changes the position of the pegs on his Airways Counter to reflect this increase.

Figure 5:
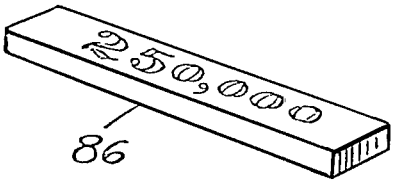
FIG. 5 is a perspective view of a Merger Bar, imprinted to show a value, in the play of the game, of $250,000.00.

A player successfully completing two Control Tower Pairs, joined by a green dotted line on the central pictorial map, is awarded a Merger Bar, FIG. 5 at 86, by the ATC. This is laid across the Connector Bars and automatically increases the value of the player's airline system or empire by an additional $250,000.00. The player changes the position of the pegs on his Airways Counter to reflect this increase.

Figure 6:
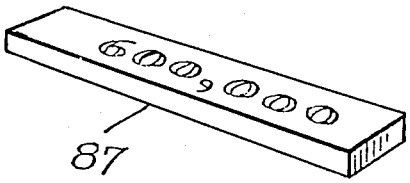
FIG. 6 is a perspective view of a Grand Merger Bar, imprinted to show a value, in the play of the game of $600,000.00.

A player successfully completing the third Control Tower Pair, in a triangle joined by green dotted lines on the central pictorial map, is awarded by the ATC a Connector Bar, two Merger Bars and a Grand Merger Bar, FIG. 6 at 87. The player first places the Connector Bar between the named City Space Control Towers, to form a third Control Tower Pair. Then he lays the Merger Bars across the appropriate Connector Bars. Finally, the Grand Merger Bar is laid across the Merger Bars. This particular action increases the player's airline system or empire as follows: $100,000.00 for the Connector Bar; $250,000.00 for each of the two Merger Bars; and $600,000.00 for the Grand Merger Bar. The player then changes the position of the pegs on his Airways Counter to reflect this increase, or a total increase of $1,200,000.00. During the remaining segment of the game, all Merger and Grand Merger Bars, and their corresponding City Space Control Towers, are immune from removal by an opponent. The Control Towers, under Merger or Grand Merger Bars, may only be removed to pay a special penalty, as later described.

When one player, for example player A, lands on a City Space containing the Control Tower of another player, for example player B, a penalty is decided in the following manner: if player A does not have any Control Towers on the central pictorial map, play resumes. Otherwise, player B has one chance to rotate the spinner, FIG. 8 at 89, and remove from the central pictorial map one of player A's Control Towers, from the section indicated by the arrow, (in the case of a striped section, (example blue and red), the player may select from either color section), and its corresponding Control Tower from the City Space on the arrival and departure course or pattern. If the area indicated by the arrow is empty of player A's Control Towers, play resumes. (For further definition, the purpose for the fifth section of the spinner being one half the size of the other four sections is as follows: the four striped sections each represent the various two-color sections (example—blue and red) held by the eight City Spaces on the central pictorial map. The fifth solid section represents the color section held by the four City Spaces on the central pictorial map.)

A player may not break a Control Tower Pair in a section, until all separate or single Control Towers in that section have been removed. Player B keeps the opponent's Control Towers, but returns any Connector Bar to the ATC. Turn then passes to the left of the penalized player.

If a player—whose City Space is occupied by an opposing player—fails to spin the arrow before the next player throws the dice, the penalty is lost.

A player successfully completing placement of a Merger Bar or Grand Merger Bar, eliminates the City Spaces under these bars from removal by an opponent, for the remainder of the game.

A player's airline system or empire is increased $30,000.00, whenever an opponent's two Control Towers, one from the central pictorial map and the corresponding one from the City Space on the arrival and departure course or pattern, are removed. Likewise, the opponent reduces his airline system or empire by the value of the particular City Space, noted at the inner end thereof, and, if removed, the value of a Connector Bar. Note: a player's own airline Control Towers do not hold any value, until used in play by placing on a City Space and the corresponding space on the central pictorial map on the point indicated next to the identical name of the City Space.

If player A lands on a City Space held by an opposing player, and the City Space is under a Merger Bar or a Grand Merger Bar, player A pays a special penalty to player B, as follows. If under a Merger Bar, player A gives two Control Towers, of the same airline, or $30,000.00 to player B; if under a Grand Merger Bar, player A gives four Control Towers of the same airline, or two Control Towers may be of one airline, and the other two Control Towers of another airline, or $60,000.00.

These penalties are paid either from (a) the player's hand, or (b) by removing a player's Control Tower from a City Space under his airline on the arrival and departure course or pattern, and the corresponding space on the central pictorial map on the point indicated next to the identical name of the City Space, and subtracting the City Space value from the airline system or empire in any combination equal to or exceeding the required sum to pay the penalty, as outlined above.

A player unable to pay the penalty, retires from the game. A player forced to remove his Control Towers, which are under a Merger Bar or a Grand Merger Bar, to pay a penalty, automatically loses the value of the Merger Bar or Grand Merger Bar, and the respective Connector Bars and subtracts their value from his airline system or empire on his Airways Counter. The value of the Connector Bar, Merger Bar and Grand Merger Bar, or $1,000,000.00, $250,000.00 and $600,000.00, respectively, cannot be used to pay a penalty to an opposing player. The player removes only enough City Space Control Towers to pay the penalty. For example if a player needs four Control Towers to pay a penalty, and must obtain them from those under a Grand Merger Bar, he: (1) removes the Grand Merger bar, and returns it to the ATC, subtracting $600,000.00 from his airline system or empire; (2) removes two Merger Bars and returns them to the ATC, subtracting $250,000.00 for each bar, or a total of $500,000.00 from his airline system or empire; (3) removes a Connector Bar and returns it to the ATC subtracting $100,000.00 from his airline system or empire; (4) removes the Control Towers, two from the central pictorial map and two from the corresponding City Spaces on the arrival and departure courses or pattern, in order to pay the penalty. The player then subtracts the value of each City Space from his airline system or empire, according to the value for each space, noted in the color section at the inner end, showing the landing rights fee value for that particular space.

A player may, at any time, transfer with the ATC: (1) opponents Control Towers for his own Control Towers or money; (2) money from his hand for his own Control Towers. A player must transfer two Control Towers of the same airline during each exchange. For each opponent's two Control Towers, a player is given two of his airline Control Towers, or $30,000.00. Likewise, a player pays the ATC $30,000.00 to receive two of his airline Control Towers. Exchange of money for your own Control Towers reduces the value of your empire, until they are used in play.

If during the game, Control Towers of a certain airline become unavailable to the ATC, the ATC requests from the player or players holding the most Control Towers of the declared airline, and gives the player $30,000.00, plus a bonus of $10,000.00 for every two Control Towers returned.

When a player does not have either sufficient money or Control Towers, in his hand, or on the central pictorial map, and lands on an opponent's City Space, and is unable to pay the penalty fee, he is automatically retired from the game, with the turn then passing on to the left, or, in the case of a game with two players, the remaining player wins the game.

The first player to build an airline system or empire of the following value wins the game: Four players—$1,500,000.00; three players—$2,000,000.00; or two players—$2,500,000.00, or forces his opponent to retire prior to reaching the declared value.

Reference is now made to FIG. 12 of the drawings, wherein the above described invention is shown to include one or more additional panels 96, of circular shape, and which are of a size so as to each cover the above described course or pattern; each panel 96 having a playing field imprinted thereupon, relating to a different geographical area. In the example illustrated in FIG. 12, the panel 96 has a map 97 of the United States imprinted thereupon, the map defining the outline of all the states, and, additionally, indicating the name and location of a city in at least thirty-six of the states. Additionally, each state area is colored a specific color, so that the map 97 is comparable in characteristics to the Europe map, shown in combined FIGS. 1A and 1B.

The map 97 is surrounded by a circular course or pattern 98, of thirty-six City Spaces, in a same manner as the City Spaces that are shown in combined FIGS. 1A and 1B, except that the circular course or pattern 98 is imprinted with the names of state capitals of the United States; the pattern 98 thus relating to the map 97 specifically, just as the City Spaces in combined FIGS. 1A and 1B are imprinted with names of cities of Europe, so as to relate to the Europe map shown therewith. The City Spaces on pattern 98 likewise are imprinted with colors that correspond to the colors of the particular states shown on map 97, and where they are located.

In use, the panel 96 is simply placed upon the center of the board 1, so that runways and taxiways of the board 1 align with the City Spaces of the panel 96.

Thus, a same type of game can be played, but which, for variety, is more refreshing, by relating to different geographical areas.

Still other panels may be provided, that relate specifically to still other geographical areas, such as for example: The Orient alone, the entire World, or the like.

Thus, the present invention covers variations in design thereof.

Having thus described one illustrative form of the invention, it is to be understood that although specific terms are employed, they are used in a generic and descriptive sense, and not for purposes of limitation, the scope of the invention being set forth in the following claims.

I claim:

1. A board game apparatus comprising:

a game board with a playing field imprinting upon one side thereof;

a geographical map including a plurality of territories imprinted on said playing field, each territory identified by distinctive indicia;

at least one city designation imprinted within each of said territories;

a course imprinted on said playing field defining a circuit about said map, said course being divided into a plurality of playing spaces;

first identification means imprinted on some of said playing spaces corresponding to the indicia on one of said territories;

second identification means imprinted on some of said playing spaces corresponding to the indicia on one of said city designations;

a plurality of starting bases imprinted on said playing field each having distinctive indicia thereon;

one or more pathways extending between each of said starting bases and said course;

a plurality of first playing pieces being initially positioned on said starting bases and for moving along said pathways and about said course, each of said first playing pieces including indicia for associating each playing piece with one of said starting bases;

dice for controlling the movement of said playing pieces about said course;

a plurality of second playing pieces for being placed on said city designations on said map, said second playing pieces including indicia corresponding to the indicia on one of said starting bases; and a spinner for determining penalties in the game, said spinner including a spinner board divided into a plurality of different sections and an arrow for pointing to any one of said coded sections to determine from which territory of said map a player removes an opponents second player piece when under a penalty situation, said sections including indicia corresponding to said first identification means so that each section is associated with one or more territories.

2. The board game apparatus of claim 1 further comprising a plurality of connector bars for being placed across the top of two of said second playing pieces, each of said connector bars being of a length sufficient to span the distance between said second playing pieces when placed on selected adjacent city marks on said map.

3. The board game apparatus of claim 2 further comprising a plurality of merger bars for being placed across two of said second playing pieces, said merger bar each having a length sufficient to span the distance between said second playing pieces when placed on selected adjacent city marks on said map, said merger bars including indicia identifying said merger bars as being more valuable than said connector bars.

4. The board game apparatus of claim 3 further comprising a plurality of grand merger bars for being placed across two of said second playing pieces, each of said grand merger bars being of a sufficient length to span the distance between said second playing pieces when said second playing pieces are placed on selected adjacent city marks on said map, each of said grand merger bars including indicia identifying said grand merger bars as being more valuable than said merger bars and said connector bars.

5. The combination as set forth in claim 4 further comprising a deck of tower call cards for controlling the game when said first player pieces land on selected playing spaces.

6. The board game apparatus of claim 1 further comprising a plurality of counters for use in maintaining the running total score for each player, said counters including a peg board with movable pegs.

7. The combination set forth in claim 1 further comprising one or more separate panels for covering said course and said map, each of said panels being imprinted with a different map and a corresponding course.

8. The board game apparatus of claim 1 wherein said first identification means comprises a color coding scheme in which a plurality of colors are imprinted on selected playing spaces and matching colors are imprinted on said territories so that each colored playing space is associated with a territory of the same color.

9. The board game apparatus of claim 1 wherein said second identification means comprises city names imprinted on selected playing spaces and imprinted adjacent the city marks on said map, so that said selected playing spaces are uniquely identified with a city mark on said map.

10. The board game apparatus of claim 1 wherein said pathways comprise runways, one runway extending from each starting base to said course.

11. The board game apparatus of claim 1 wherein said pathways comprise taxiways extending from said course to each of said starting bases.

12. The board game apparatus of claim 1 wherein said pathways comprise:

taxiways extending from said course to said starting bases; and runways extending from said starting bases at the end of said taxiways to said course.

13. The board game apparatus of claim 1 wherein said first playing pieces comprise airplane shaped pieces, each of said airplane shaped pieces including a unique airline indicia, said starting bases including corresponding airline indicia so that each airplane shaped piece is associated with one starting base.

14. The board game apparatus of claim 1 wherein said special designations include takeoff, taxiway, and tower call designations for controlling the play of the game.

15. The board game apparatus of claim 1 wherein said second playing pieces comprise miniature control towers.

16. A board game apparatus comprising:

a game board with a playing field imprinted on one side thereof;

a geographical map imprinted on said playing field of said game board, said geographical map including a plurality of territories;

a course imprinted on said game board defining a continuous circuit and being divided into a plurality of playing spaces;

control tower position marks imprinted on said maps;

identification means imprinted on said game board for identifying each playing space with a corresponding one of said control tower position marks;

first playing pieces for movement about said course on said playing spaces;

a plurality of miniature control towers for being placed on said control tower position marks and for being removed from said control tower position marks in accordance with the movement of said first playing pieces about said course;

connecting bars for being positioned across said control towers when placed on selected ones of said control tower position marks, said connecting bars each having sufficient length to span the distance between said control towers when placed on selected adjacent control tower position marks, each of said bars being additionally imprinted with indicia for identifying the value and function of said bar; and a spinner having a plurality of different sections and an arrow for pointing to one of said sections for controlling the removal of said control towers from said map, the sections of said spinner including means for identifying said section with one or more of said territories.

17. The board game apparatus of claim 16 further comprising:

taxiways extending from said course to predetermined destinations; and runways extending from said predetermined destinations back to said course, so that said first playing pieces may move along said taxiways and runways instead of said course.

18. The game board apparatus of claim 16 wherein said territories, said playing spaces, and said spinner sections are color coded to indicate that selected territories, playing spaces, and spinner sections are associated with one another.

* * * * *